United States Patent [19]

Lawrence et al.

[11] 4,318,621

[45] Mar. 9, 1982

[54] TRANSIT CONCRETE MIXER WITH DISPLACEABLE CHARGING HOPPER

[75] Inventors: William A. Lawrence; John A. O'Dea, both of Columbus, Ohio

[73] Assignee: Jaeger Machine Company, Columbus, Ohio

[21] Appl. No.: 794,750

[22] Filed: May 9, 1977

[51] Int. Cl.[3] ..... B28C 5/42

[52] U.S. Cl. ..... 366/41; 366/68; 366/59

[58] Field of Search ..... 366/41, 68, 44, 59

[56] References Cited

U.S. PATENT DOCUMENTS

| | | | |
|---|---|---|---|
| 2,267,801 | 12/1941 | Peters et al. | 366/41 X |
| 2,563,963 | 8/1951 | Rockburg | 366/41 |
| 2,854,224 | 9/1958 | Broberg | 366/41 |
| 2,879,978 | 3/1959 | Hilkemeier et al. | 366/41 |
| 2,904,318 | 9/1959 | Broberg | 366/41 |
| 3,061,282 | 10/1962 | Hilkemeier | 366/41 |
| 3,112,100 | 11/1963 | Prichard | 366/41 |
| 3,576,314 | 4/1971 | Sannipoli | 366/41 |

*Primary Examiner*—Philip R. Coe
*Attorney, Agent, or Firm*—Francis T. Kremblas, Jr.; Frank H. Foster

[57] ABSTRACT

A transit concrete mixer is provided having a displaceable charging hopper which may be moved between a charging position wherein a discharge conduit thereof projects into the interior of the mixer drum and a relatively displaced position where the discharge conduit is removed from the drum to facilitate discharge of concrete from the drum. The charging hopper is pivotally attached to a support structure which also carries the rear end portion of the mixer drum and is selectively movable in a vertical plane about a horizontal axis. The relative location of the horizontal axis for pivoting movement of the charging hopper is located with respect to the terminal end of the hopper's discharge conduit such that the hopper and its associated conduit may be swung from one position to the other without interference with the mixer drum and its interiorally mounted blade elements. A hydraulic actuating ram is provided to facilitate the swinging movement of the charging hopper. A discharge stop plate is also provided in the combination with this plate attached to and carried by the charging hopper for concurrent displacing movement between a normal position closely adjacent the rear end of the mixer drum and a position relatively remote thereto.

3 Claims, 7 Drawing Figures

TRANSIT CONCRETE MIXER WITH DISPLACEABLE CHARGING HOPPER

BACKGROUND OF THE INVENTION

Transit concrete mixers conventionally include a rotatable mixer drum having a charging hopper located at a rear end portion thereof along with a discharge chute. The drum itself is conventionally mounted for rotation about a longitudinal axis that is upwardly and rearwardly inclined. The function of the charging hopper is to facilitate placement of the concrete mix or its constituents within the interior of the drum where they are further agitated or mixed in accordance with the predetermined requirements. These mixer drums are provided with a number of spiral blade elements that extend throughout the interior of the drum and perform the mixing and agitating functions as well as to utimately provide an auger type operation for discharge of the fluid concrete through the charging and discharge opening at the rear end portion of the drum.

The charging hopper, in accordance with previous construction practices, has been mounted in fixed relationship to the rear end portion of the mixer drum and is customarily attached to a rear support stand and associated components for the mixer drum. This arrangement and fixed attachment of the charging hopper has been found to seriously interfere with the discharge of the concrete from the drum in many instances. This interference is of particular consequence in the case where the concrete must have a characteristic low slump, or a relatively high viscosity, and is a resultingly very stiff mixture. This stiff concrete having a low slump characteristic cannot be rapidly discharged from mixers having the fixed charging hoppers, in view of the relatively small clearances between a terminal end portion of the hopper that projects into the interior of the drum and is in close association with the inner edge surfaces of the blade element. A primary cause of the interference is that the stiff concrete mixture with a low slump characteristic builds up on the blade elements during discharge operations and generally piles up substantially higher than the inner edges of the blades and ultimately engages and comes into contact with the discharge conduit of the hopper. When this concrete thus reaches and builds up into the discharge conduit of the hopper, it substantially increases the resistance to movement of the concrete out of the drum and seriously hinders the rapid discharge of the concrete. In some instances it is necessary to reverse the drum rotation to clear the obstruction that is thus formed between the stiff concrete and the discharge hopper.

A solution to the interference problem with a fixed charging hopper could be achieved through alteration of the mixer drum dimensions to enlarge the discharge and charging opening at the rear end portion of the drum. Another type of alteration in structural dimensions to obtain a solution to this problem would be to decrease the depth of the blade elements particularly in the rearward most portion of the drum that is in association with the discharge conduit of the hopper. Such alterations in dimensional characteristics of the drum, however, are undesirable as they materially affect the operation of the drum in those instances where the drum is providing concrete having a much greater slump and thus relatively more fluid. It is only in the instance where the concrete specifications for a particular job require delivery of the relatively stiff and low slump concrete that the interference problem is present and consequently it is not desirable to alter drum construction and configuration to eliminate the interference problem which is only encountered in one particular mode of operation of a transit mixer. Such modification could materially reduce the efficiency and capabilities of the mixer for all other operations.

SUMMARY OF THE INVENTION

In accordance with this invention a transit mixer is provided with a charging hopper that may be selectively displaced from its operative charging position with respect to the mixer drum and a second position where it is removed from such close association with the drum as to eliminate any problem of interference with the discharge of concrete from the drum. The charging hopper includes a discharge conduit that normally extends and projects into the rear end portion of the mixer drum. The hopper itself is mounted by pivot arms on a supporting stand or structural frame that is also utilized in supporting the mixer drum at the rear end portion thereof. Preferably, the pivot axis for the charging hopper is located with resect to the normal most inward position of the hopper's discharge conduit so that there will be no interference between the hopper conduit and the adjacent portions of the mixer drum and associated blade elements during pivoting movement of the charging hopper between its two positions.

With a pivoted charging hopper as provided in accordance with this invention, a transit mixer drum may be readily operated at a speed wherein the low slump concrete may be rapidly discharged. This rapid discharge of the concrete is not impeded by the fact that such low slump concrete may build up to a depth at the discharge end substantially greater than the depth of the blade elements. This merely results in the faster discharge of the concrete and the discharge rate may thus be increased to the point where the time required for complete emptying of the mixer drum is effectively cut in half or even more. It is this ability to rapidly discharge the low slump concretes that enhances operations of an otherwise conventionally configured transit mixer drum in supplying the concrete requirements for road paving operations or other similar constructions.

Providing of an displaceable charging hopper enhances the resultant mixer combination in other respects. Cleaning of the drum and blades is greatly facilitated as an operator may remain standing on the ground at the rear of the machine while directing a stream of water from a hose into the open end of the mixer drum. If the charging hopper were not displaceable, it would be necessary for the operator to climb up onto the mixer to a position where he directs the stream of water through the narrow space between the charging hopper and the blades. Repair of interior components of the drum or the blades is also greatly facilitated by enhanced accessibility through the open end of the drum. Workmen may readily enter the drum through the end opening when the charging hopper is in its displaced position relatively remote to the drum.

In another embodiment of this invention, a discharge stop plate is provided to better direct discharging concrete into the discharge chute of a mixer of this type. In a mixer designed primarily for use with low slump paving types of concrete, the use of such a mixer with high slump, relatively fluid concrete mixes generally results in at least some of the concrete overshooting a guide chute or apron located at the rear of the mixer drum. This stop plate is mounted on or carried by the charging hopper for concurrent displacing movement. When the hopper is in the normal position, it is disposed in closely adjacent relationship at the rear of the guide chute or apron located immediately rearward of the mixer drum. The stop plate prevents rapidly discharging concrete from overshooting the apron but, when displaced with the hopper, the stop plate does not interfere with cleaning of the drum or other components.

These and other objects and advantages of this invention will be readily apparent from the following detailed description of an embodiment thereof and the accompanying drawings.

DESCRIPTION OF THE DRAWING FIGURES

DESCRIPTION OF THE ILLUSTRATIVE EMBODIMENT

Figure 1:
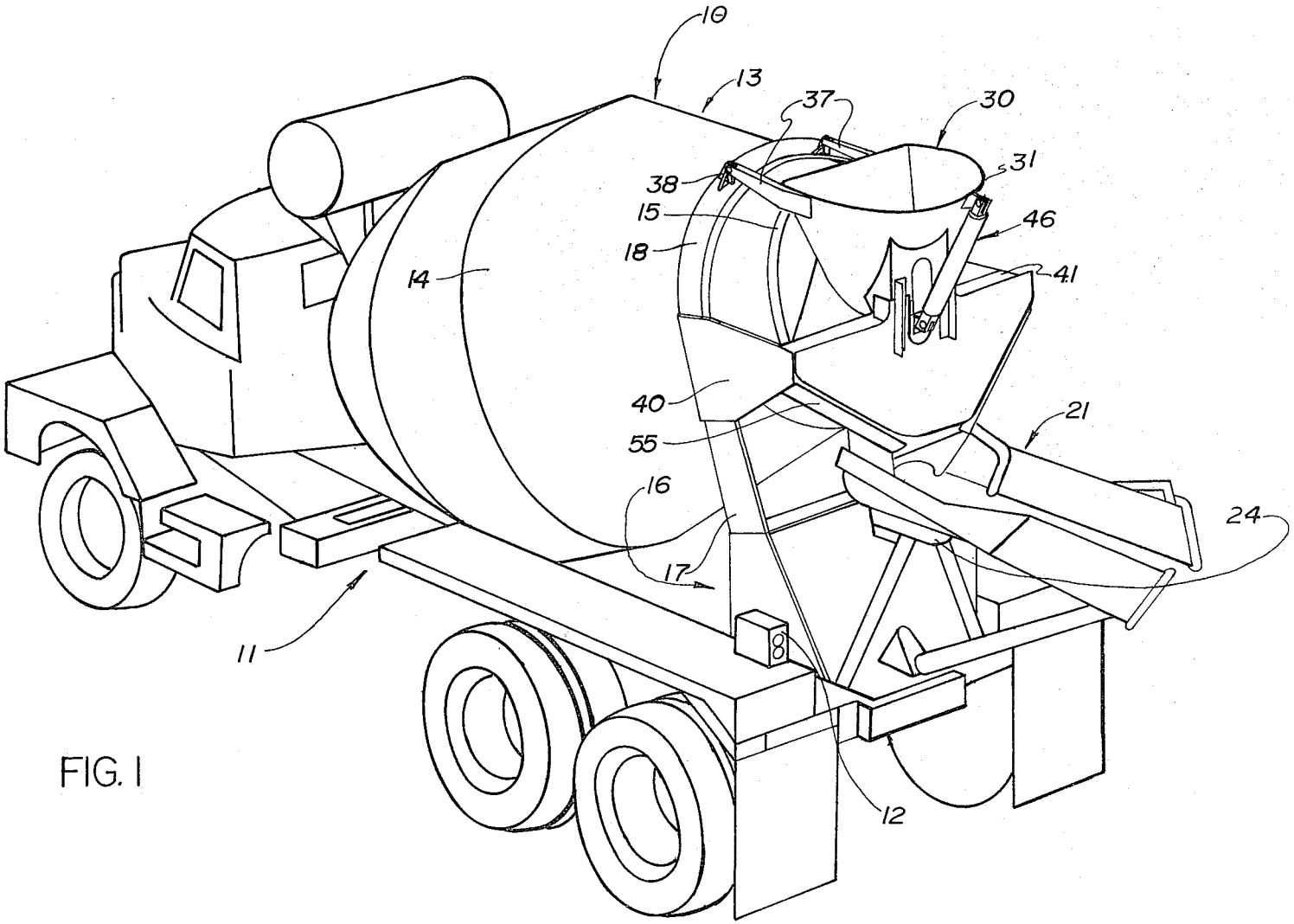
FIG. 1 is a perspective view of a truck mounted transit mixer provided with a displaceable charging hopper.

Having reference specifically to FIG. 1, a transit concrete mixer indicated generally at 10 is shown as typically installed on a truck chassis 11. Specific components of the truck chassis are not illustrated or described other than a hydraulic pump apparatus 12, which for illustrative convenience, is shown mounted on a rear fender guard of the truck chassis. This particular hydraulic pump apparatus 12 is utilized to provide hydraulic power for operation of some components as will be explained hereinafter. Included in the concrete mixer 10 is a mixer drum 13 which has a rear end portion 14 that is provided with a charging and discharge opening 15. As is the conventional practice, the mixer drum 13 is mounted on the truck chassis and associated frame components for rotational movement about its longitudinal axis which is upwardly and rearwardly inclined so as to place the charging and discharge opening 15 at a relatively elevated position. Support apparatus and drive mechanisms for the drum are not indicated or illustrated in substantial detail as such components are well known in the art. However, for the purposes of illustrating the specific embodiment of this invention, it will be noted that the rear end portion of the drum 13 is carried by a rear support stand 16. This rear support stand 16 includes a base support 17 and an overhead arch 18. The base support 17 includes support rollers 19 which are adapted to engage a roller track 20 which is carried on the exterior surface of the frusto-conically shaped rear end portion 14 of the mixer drum. Location of the rollers 19 can be best seen in FIG. 3.

Also carried on the rear support stand 16 is a discharge chute assembly 21 for facilitating placement of the concrete as it is discharged from the mixer drum. This discharge chute assembly 21 includes a receiver 22 having two or more elongated channel extensions 23 for obtaining the necessary length for proper placement of the concrete. The receiver section 22 may be pivotably mounted for rotation about a vertical axis on a bearing bracket 24 which is attached to the base support 17. Additionally, the discharge chute assembly 21 is mounted for vertical swinging of this unit is pivotably attached to a connector bracket attached to the base support 17 while one end of a piston rod is attached to the discharge chute assembly 21. Hydraulic power for operation of the cylinder and piston is obtained from the pump apparatus 12 through suitable control valve mechanisms (not shown).

In accordance with this invention, a charging hopper assembly 30 is pivotably mounted on the rear support stand 16 for relative vertical swinging movement with respect to the charging and discharge opening 15 of the mixer drum. Included in the charging hopper assembly is the hopper structure 31 which is of a general funnel shape having an upper open end for receiving the materials that are to be directed into the mixer drum. The lower end of the hopper structure 31 includes a discharge conduit 32 which is joined to the upper main body portion 33 of the hopper at a relatively downward and forwardly directed angle. As can be best seen in FIG. 2, this angular relationship of the discharge conduit 32 is such that with the hopper structure 31 supported in the full line illustrated normal position, the discharge conduit will generally align with and project along the longitudinal axis of the mixer drum.

Figure 5:
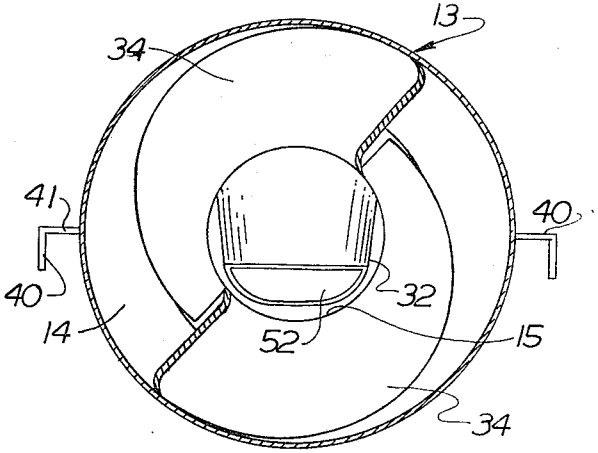
FIG. 5 is a sectional view taken along line 5—5 of FIG. 2.

Also included in the mixer drum 13 are a pair of spiral blade elements 34 which are shown in FIG. 5. These spiral blade elements are mounted on the interior of the drum surface and project generally radially inward. Each of the blade elements is of a predetermined depth and the innermost edges thereof define a surface of revolution as the mixer drum is rotated about its longitudinal axis. This surface of revolution terminates in a circular aperture at the charging and discharge opening 15 of the drum. The circular aperture 35 is coaxial with the longitudinal drum axis and the discharge conduit 32 of the hopper thus projects into the drum through this circular aperture 35. As can be best seen in FIG. 5, there is only a small clearance between the adjacent surfaces of the discharge conduit and the edges of the blade elements 34.

Providing the necessary support for the hopper structure 31 are fixed brackets 38 and a pair of hinged arms 37. Each of the hinged arms 37 comprises an elongated, channel-form structure having one end thereof secured, as by welding, to the exterior surface of the hopper structure 31. The forwardly projecting ends of the hinged arms 37 are pivotally secured in respective sets of hinge brackets 38. These hinge brackets 38 are secured to the exterior of the overhead arch 18 and are preferably located thereon so that neither the bracket 38 nor the hinge arms 37 will normally project above the uppermost point of the overhead arch and thus not increase the vertical clearance requirements for this mixer and its pivoted charging hopper. It will also be noted, as can be best seen in FIG. 3, that the hinge arms 37 are secured in the respective set of brackets 38 by hinge pins 39 which are aligned along a horizontal hinge axis.

Providing the necessary vertical support to maintain the hopper structure 31 in its illustrated normal position, is the fixed bracket assembly 36. This bracket assembly 36 includes a pair of rearwardly extending arms 40 which are attached at one end to the overhead arch 18.

These arms 40 are vertically positioned to support an interconnecting and transversely extending stop bracket 41 at a position slightly below a surface portion of the upper main body portion 33 of the hopper. Secured to the rearwardly inclined surface portion of the hopper is a support bracket 42 having a lower base plate 43. With the hopper structure 31 located in the illustrated normal position, this base plate 43 will contact the upper surface of the stop bracket 41 and thus provide the necessary vertical support for the hopper structure.

Figure 2:
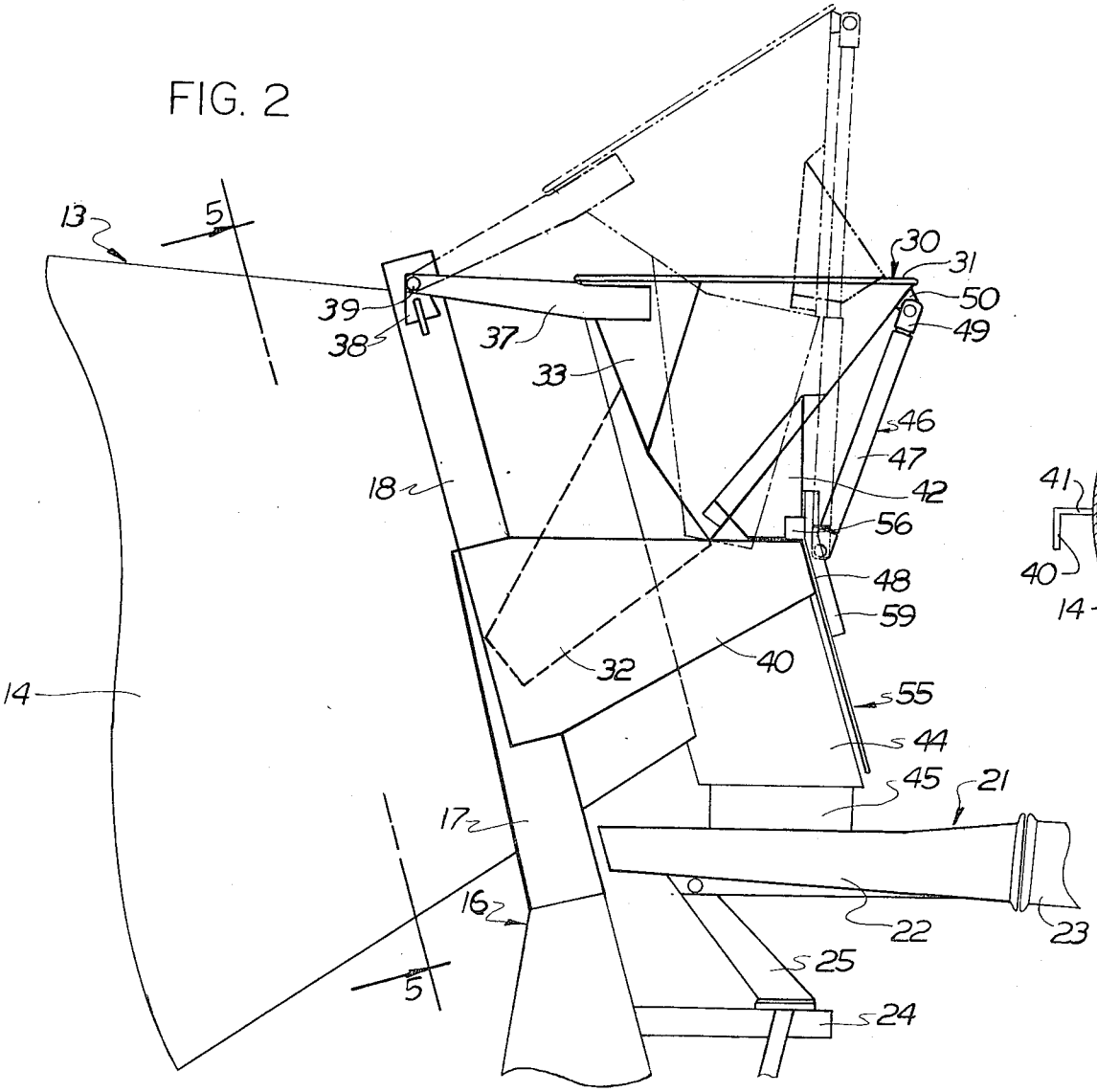
FIG. 2 is a fragmentary side elevational view on an enlarged scale of the rear portion of the transit mixer.
Figure 3:
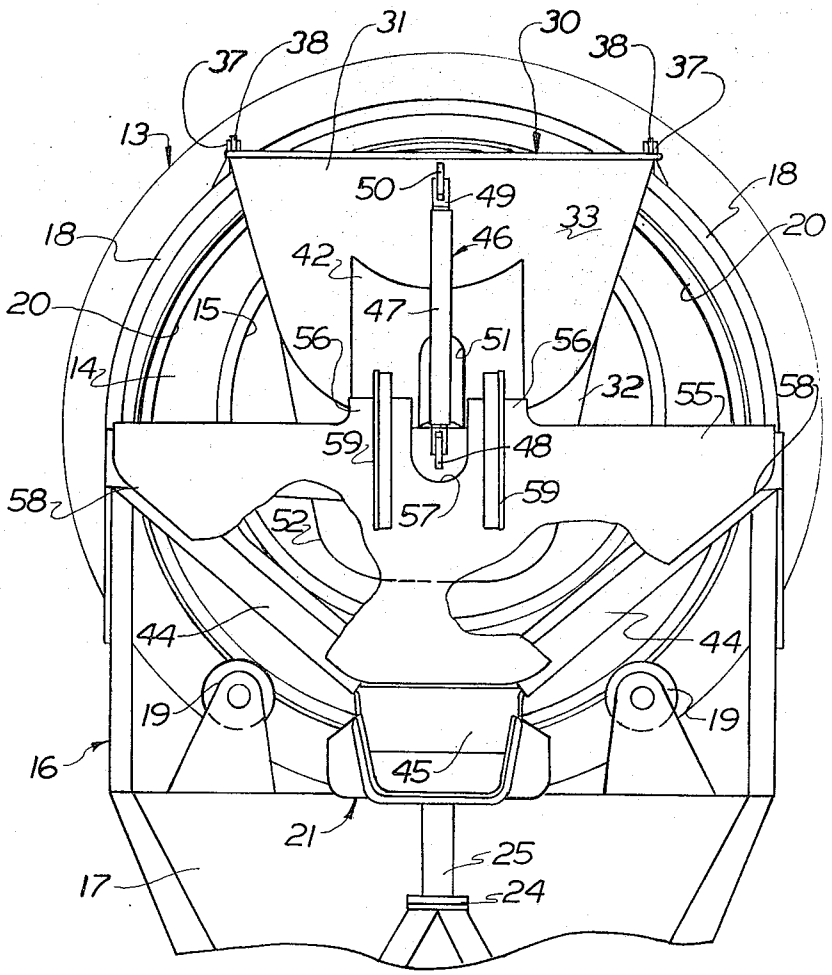
FIG. 3 is an end elevational view of the mixer as seen at the right side of FIG. 2.
Figure 4:
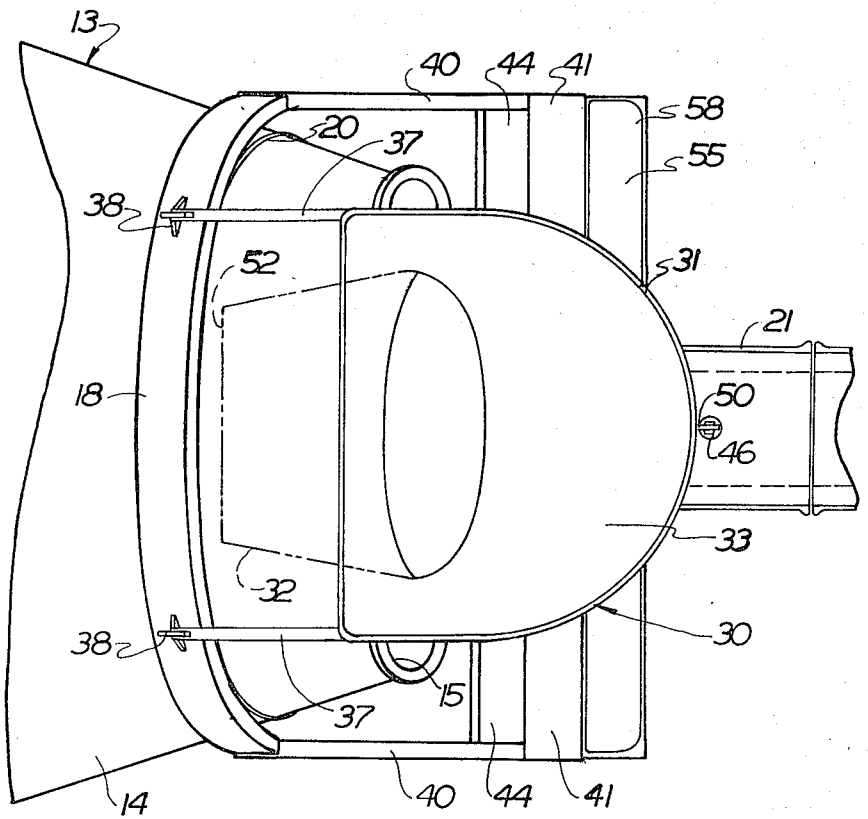
FIG. 4 is a top plan view of the mixer as seen in FIG. 2.

Also carried by the bracket assembly 36 is a guide chute or apron 44 having two side elements which are relatively convergent in a downward direction. The two side elements of the apron 44 terminate in a U-shaped skirting 45 which opens toward the rear of the mixer and is positioned in alignment with the receiver portion 22 of the discharge chute assembly 21. It will be noted that the apron 44 in FIGS. 2 and 3 is positioned so as to provide the necessary guidance for the concrete as it is discharged from the mixer drum 13 and into the discharge chute assembly 21.

Pivoting of the hopper structure 31 is readily accomplished by means of a hydraulic ram 46. This hydraulic ram includes a cylinder 47 having one thereof pivotably connected by means of connector lugs 48 to the stop bracket 41. Extending out of the upwardly directed end of the cylinder 47 is a piston rod 49 which has its exterior end connected to the upper main body portion 33 of the hopper structure by the respective connector lugs 50. Hydraulic power for the operation of the hydraulic ram 46 is obtained from the same apparatus 12 that is utilized for operation of the cylinder and piston unit 26 that operates the discharge chute assembly. Suitable hydraulic conduits are provided for interconnecting this ram 46 with the pump apparatus and the associated valving which is not otherwise shown. That valving preferably is of a type which permits the operator to alternatively select for operation, either the cylinder and piston unit 26 for effecting necessary vertical elevation of the discharge chute assembly or for actuation of the ram 46 in pivoting the hopper structure 31 to either the normal position shown in full lines in FIG. 2 or an upwardly pivoted position as shown in broken lines or as can be best seen in full lines in FIG. 7. It will also be noted in FIGS. 3 and 7, that the support bracket 42 is provided with a rearwardly opening notch 51 to accommodate the ram 46 as the hopper 31 reaches the uppermost portion of its vertical swinging movement.

Figure 7:
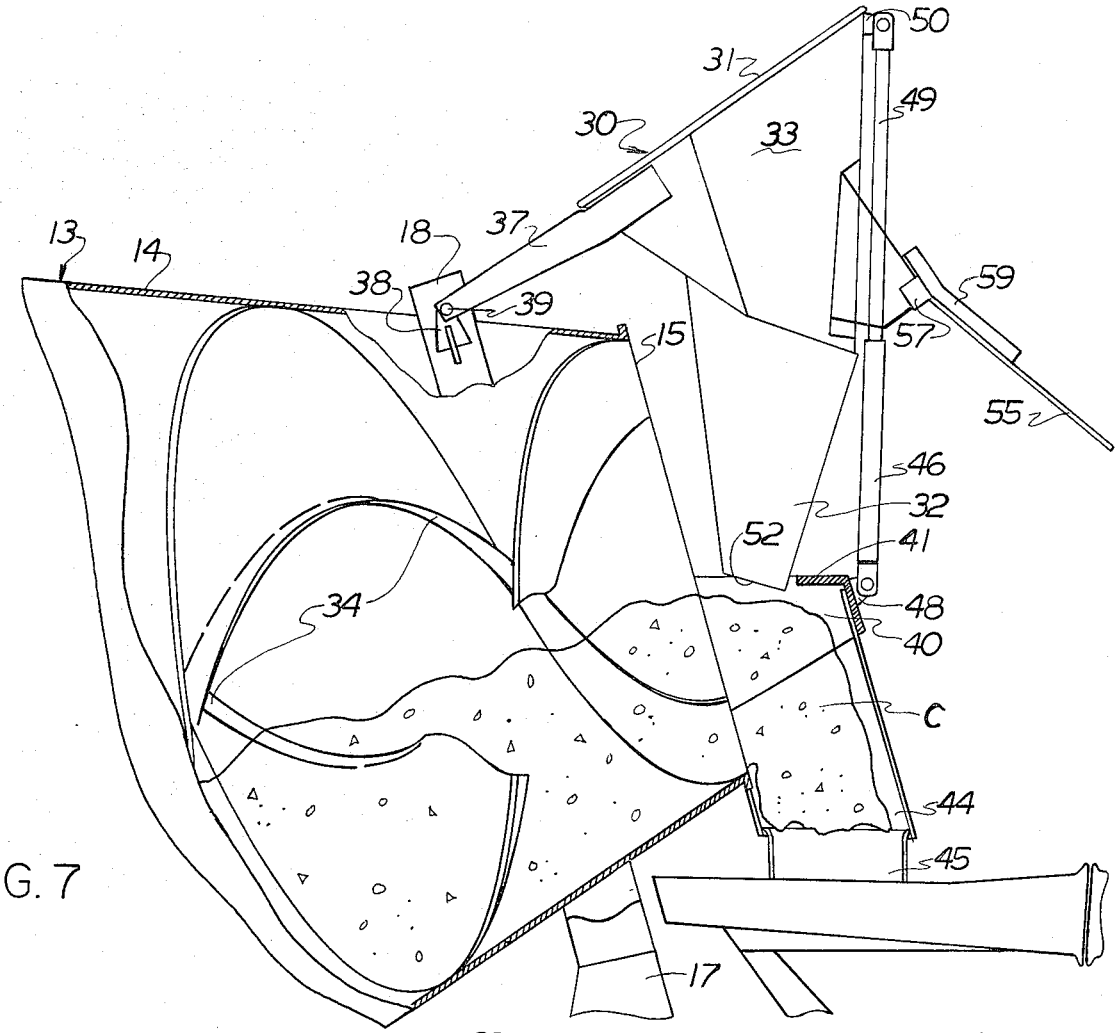
FIG. 7 is a sectional view similar to FIG. 6 but showing the hopper in its displaced position.
Figure 6:
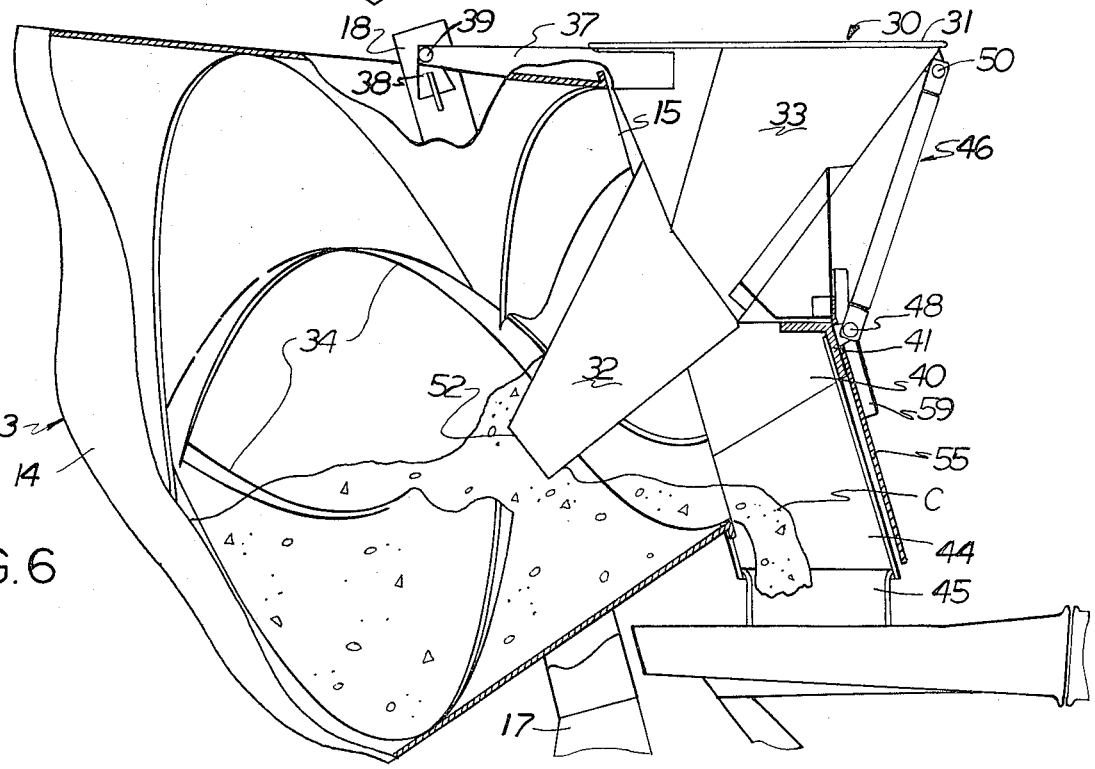
FIG. 6 is a sectional view taken along line 6—6 of FIG. 5.

The functional advantages achieved through the incorporation of a pivotably mounted charging hopper is diagrammatically illustrated in FIGS. 6 and 7. Referring first to FIG. 6, it will be seen that the discharge conduit 32 of the hopper structure 31 is projecting into the interior of the rear end portion 14 of the mixer drum 13. As previously indicated, the discharge conduit is positioned to generally extend along the longitudinal axis of the mixer drum. In this normal position of the hopper structure 31, it will also be seen that the discharge conduit 32 terminates at an open end 52 which lies in a plane that extends substantially through the roller track 20. With the hinge bracket 38 mounted on the overhead arch 18 which is also in a plane coextensive with that passing through the roller track, it will be seen that the discharge conduit 32 will not be displaced further downwardly with respect to the longitudinal axis of the drum than the illustrated position in FIG. 6. The extreme terminal end 52 will thus move along an arcuate path 52 as indicated in FIG. 6 during pivotable displacement to the position as shown in FIG. 7. This relative location of the hinge 39 for the hopper structure thus prevents any interference between surfaces of the discharge conduit and either the inner edges of the blade elements 34 or portions of the drum 13 or the stop bracket 41.

With the charging hopper 31 swung to the displaced position as shown in FIG. 7, it will be seen that the hopper discharge conduit 32 is completely removed from the interior of the drum 13 and thus fully withdrawn from the flow path of the concrete C as it is discharged from the drum. In this displaced position, the hopper discharge conduit will not interfere with the concrete flow as would be the case if the hopper were left in the normal position as shown in FIG. 6. When discharging a low slump concrete mix, the concrete tends to build up to a substantial depth at the charging and discharge opening 15 and, in the case of a fixed hopper mixer, would tend to accumulate to a depth as illustrated in FIG. 6 such that it will block the flow path of the concrete, thereby resulting in a diminished flow. However, with the pivoted charging hopper assembly 30 of this invention, any such impedance to the concrete flow is eliminated and a rapid discharge rate can be readily achieved through appropriate control of the rotational speed of the mixer drum.

While the mixer drum and displaceable charging hopper provide a particularly improved transit increase in rate of discharge of low slump concrete from mixers specifically designed for low slump concrete, the versatility of such mixers can be further enhanced by the incorporation of a discharge stop plate into the combination. A discharge stop plate 55 is shown in the several figures of the drawing and is seen to comprise a generally triangularly shaped, rigid plate disposed in an inverted manner. This plate 55 is attached at its upper end to the support bracket 42 secured to the hopper 31 by attachment flanges 56 and includes a central cut out or notch 57 to accommodate the ram 46. Preferably, the plate 55 is of a size such that the downwardly convergent marginal edge portions 58 overlie the side flanges of the apron 44 and thereby restrict the rearward movement of the concrete as it is discharged from the drum 13. It will be noted in FIG. 2 that the plate is disposed in a slightly inclined relationship to extend parallel to the apron flanges and thus extends slightly rearwardly from its point of attachment to the hopper support bracket 42. A pair of elongated L-shaped structural members 59 are secured to the support bracket 42 and plate 55 to provide greater structural strength in attachment of the plate to the hopper and improved rigidity of the plate.

Incorporation of the discharge stop plate 55 in the previously described pivoted hopper combination neither aids nor hinders the discharge of a low slump concrete from a mixer specifically designed for use with such concrete. However, the addition of a stop plate does materially enhance the use of such a mixer with concrete mixes of relatively high slump as these mixers are generally capable of discharing the high slump mixes at such a high speed that the concrete is very likely to be propelled beyond or over the apron 44. Accordingly, the hopper assembly 30 including the attached discharge stop plate 55 is left in the position illustrated in FIGS. 2 and 6 as the hopper discharge conduit 32 will not interfere with the concrete discharge operation since the high slump concrete will not build up as does the diagramatically illustrated low slump concrete in FIG. 6.

The disadvantage of merely providing a discharge stop plate mounted in fixed relationship on the mixer structure is that the plate will then seriously interfere with cleaning of the apron and associated components. It is for this reason that the stop plate in accordance with this invention is attached to the hopper so that it will be concurrently swung to the displaced position with the hopper and thereby facilitate cleaning and repair operations.

It will be readily apparent from the foregoing detailed description of the illustrative embodiment of this invention that a substantially improved transit concrete mixer is obtained. Providing such a mixer with a displaceable charging hopper enables the mixer to be operated at a relatively high discharge rate with concrete having a low slump characteristic and greatly facilitates cleaning and repair operation. This objective is achieved without structural or dimensional modification of a conventionally configured mixer drum. Incorporation of a discharge stop plate is the combination of a displaceable charging hopper further enhances the versatility and operation of a mixer while retaining the advantageous facility in cleaning and repair.

Having thus described this invention, what is claimed is:

1. In a transit concrete mixer, the combination of: a mixing drum supported for rotation about a longitudinal axis and including a rear end portion provided with an opening disposed transverse to the longitudinal drum axis, a support disposed adjacent the rear end portion of said drum, a charging hopper mounted on said support and having an upper receiving end and a lower discharge conduit projecting downwardly and forwardly with respect to said drum to normally extend through the charging and discharge opening and project a distance interiorly of said drum, mounting means for said hopper connected to said support and including a hinge means having a horizontal hinge axis disposed above said drum and forwardly of said hopper to permit pivotal swinging movement of said hopper rearwardly and upwardly in a vertical plane between a normal position with the discharge conduit projecting into said drum and a displaced position with the discharge conduit withdrawn from said drum; stop means mounted on said support in fixed relationship thereto and cooperatively interengageable with said charging hopper when the hopper is in the normal position to maintain the hopper in the normal position; and selectively operable acuator means including a fluid operated cylinder and piston assembly, said piston being axially extendable from said cylider, one of said cylinder and piston being connected to said stop means and the other connected to said hopper whereby relative axial movement of the cylinder and piston effects swinging movement of said hopper.

2. In a transit concrete mixer, the combination of: a mixing drum supported for rotation about a longitudinal axis and including a rear end portion provided with an opening for charging and discharge of the drum with said opening disposed transverse to the longitudinal drum axis, a support disposed adjacent the rear end portion of said drum, a charging hopper mounted on said support and having an upper receiving end and a lower discharge conduit projecting downwardly and forwardly with respect to said drum to normally extend through the charging and discharge opening and project a distance interiorly of said drum, said hopper mounted on said support by means permitting selective displacement of said hopper between the normal position with the discharge conduit projecting into said drum and a displaced position where the discharge conduit is withdrawn from said drum, a discharge chute assembly disposed adjacent the rear end portion of said drum to receive concrete discharged from the drum through said opening, said discharge chute assembly having a pair of downwardly convergent walls terminating in an open bottom forming an opening facing forward to receive concrete therethrough from the drum and a rearwardly facing opening, and a discharge stop plate mounted on said support for displacing movement between a position closing the rearwardly facing opening of said discharge chute assembly and a position displaced relative thereto.

3. The combination of claim 2 wherein said discharge stop plate is mounted on said charging hopper for concurrent displacement therewith.

* * * * *